US011795707B2

(12) United States Patent
Schulze

(10) Patent No.: US 11,795,707 B2
(45) Date of Patent: Oct. 24, 2023

(54) SPACER

(71) Applicant: Ralph Schulze, Dortmund (DE)

(72) Inventor: Ralph Schulze, Dortmund (DE)

( * ) Notice: Subject to any disclaimer, the term of this patent is extended or adjusted under 35 U.S.C. 154(b) by 596 days.

(21) Appl. No.: 17/050,439

(22) PCT Filed: Apr. 24, 2019

(86) PCT No.: PCT/EP2019/060474

§ 371 (c)(1),
(2) Date: Oct. 25, 2020

(87) PCT Pub. No.: WO2019/206972

PCT Pub. Date: Oct. 31, 2019

(65) Prior Publication Data

US 2021/0140180 A1 May 13, 2021

(30) Foreign Application Priority Data

Apr. 26, 2018 (DE) ..... 20 2018 102 336.5

(51) Int. Cl.
*E04F 21/22* (2006.01)
*E04F 15/02* (2006.01)

(52) U.S. Cl.
CPC ..... *E04F 21/22* (2013.01); *E04F 15/02027* (2013.01); *E04F 2201/0115* (2013.01)

(58) Field of Classification Search
CPC ..... E04F 21/22; E04F 15/02027; E04F 2201/0115
See application file for complete search history.

(56) References Cited

U.S. PATENT DOCUMENTS 4,040,222 A * 8/1977 Cull ..... E04F 13/0853 52/749.1
5,417,050 A * 5/1995 Cosentino ..... E04F 13/0819 52/235

(Continued)

FOREIGN PATENT DOCUMENTS

DE 4228601 C2 * 6/1997 ..... E04F 15/02452
DE 202018102336 U1 * 6/2018 ..... E04F 15/02027

(Continued)

OTHER PUBLICATIONS

International Search Report dated Oct. 31, 2019 in parent International application PCT/EP2019/060474.

(Continued)

*Primary Examiner* — Yaritza Guadalupe-McCall
(74) *Attorney, Agent, or Firm* — POLSON INTELLECTUAL PROPERTY LAW, PC; Margaret Polson; Christopher Sylvain

(57) ABSTRACT

The invention relates to a spacer for keeping a wall connection-side joint free, for example when laying a rigid floor covering, comprising a spacer element (2, 2.1) with a thickness, which corresponds to the width of the joint to be kept free, and an angle bracket (3, 3.1) with a strip-shaped holding limb (4, 4.1) and a holding shaft (5, 5.1) which is connected to the holding limb (4, 4.1) at the end thereof and which protrudes from the holding limb (3, 3.1). A bore (7) which extends in the vertical direction of the spacer element and into which the holding shaft (5, 5.1) engages is introduced into the spacer element (2, 2.1).

11 Claims, 2 Drawing Sheets

(56) References Cited

U.S. PATENT DOCUMENTS

| | | | | |
|---|---|---|---|---|
| 5,603,195 | A * | 2/1997 | Cosentino | E04F 21/1838 52/749.11 |
| 8,881,418 | B2 * | 11/2014 | Funk | E04F 21/22 33/700 |
| 9,783,992 | B2 * | 10/2017 | Bombino | E04B 1/7612 |
| 10,501,947 | B2 * | 12/2019 | Bunch | E04F 21/22 |
| 11,566,418 | B2 * | 1/2023 | Ben Saad | E04F 13/0855 |
| 11,649,647 | B2 * | 5/2023 | Bunch | E04F 21/1894 33/527 |
| 2013/0263462 | A1 | 10/2013 | Funk | |
| 2015/0152648 | A1 * | 6/2015 | Amer | E04F 15/02177 33/527 |
| 2021/0115662 | A1 * | 4/2021 | Ben Saad | E04F 13/0855 |
| 2021/0140180 | A1 * | 5/2021 | Schulze | E04F 15/02027 |
| 2022/0220745 | A1 * | 7/2022 | Miller | E04F 15/02027 |
| 2023/0160198 | A1 * | 5/2023 | Ben Saad | E04B 1/7675 52/365 |

FOREIGN PATENT DOCUMENTS

| | | | | |
|---|---|---|---|---|
| WO | 02079654 | A1 | 10/2002 | |
| WO | 03058007 | A1 | 7/2003 | |
| WO | WO-2020086389 | A1 * | 4/2020 | E04F 15/02005 |

OTHER PUBLICATIONS

Written Opinion of the International Searching Authority dated Oct. 31, 2019 in parent International application PCT/EP2019/060474.

* cited by examiner

SPACER

BACKGROUND

The present disclosure relates to a spacer for keeping an expansion gap at the wall free, e.g., when installing a rigid floor covering, e.g., a laminate floor.

When installing rigid floor coverings, especially those that rest loosely on the floor, a gap must be used to separate the floor covering from the wall closure. The gap should be an expansion gap, such that in the event of thermal expansion of the floor covering, it can expand accordingly, and not curl up due to being supported at the wall. Cuboid spacers are used to form such a gap. These have a thickness matching the width of the gap to be created. Typically, a gap width of 10 mm or 15 mm is preferred. These block-like spacers are installed with their narrow side facing the floor. Subsequently, a floor-covering panel, e.g., a laminate panel, is placed in front of these spacers. This way, the floor covering is installed on the floor, while maintaining a gap in the material thickness of the spacers. Following floor installation, the spacers are retracted from the gap.

Even if floor coverings can be installed with such spacers, while maintaining the desired gap, the handling of these spacers is not always without problems, as they tend to fall over. The reasons for this are, e.g., unevenness in the floor or screed area adjacent to the wall, or the presence of a softer material on the sub-floor, with which a vapor barrier and/or impact-sound insulation is to be achieved. There is also the risk that the spacers positioned at the wall will fall over, when bumping against a longer edge panel, which is why this panel must be placed very carefully against the upright spacers, in order to prevent the spacers from overturning.

SUMMARY

Proceeding from this background, an aspect of the present disclosure is to propose a spacer, which is suitable for use for the aforementioned purposes, and whose handling is improved over the previously known spacer.

This is provided according to the present disclosure by a spacer for keeping a gap at the wall connection free, e.g., when installing a rigid floor covering, which spacer comprises a spacer element with a thickness equaling the width of the gap to be kept free, and a bracket with a strip-shaped support shank for reaching under the installed floor covering, whose width is less than the gap to be created, and with a support shaft connected thereto at one end of the support shank and projecting from the support shank, wherein a hole extending in the direction of its height is drilled into the spacer element, in which drill hole the support shaft engages, and the spacer element and the bracket are detachable from one another, or the support shaft has a rotary drive contour in its end section facing away from the support shank.

This spacer has a spacer element with a thickness matching the width of the gap to be kept free. In addition to the spacer element, the spacer comprises a bracket. The bracket, itself, comprises a strip-shaped support shank and a support shaft connected thereto and projecting from the support shank. The spacer element is mounted on the support shaft, for which purpose it has a drill hole or shaft receptacle extending in its vertical direction. The spacer element and bracket are detachable according to one embodiment. To install the spacer, the support shank of the bracket is moved in a direction away from the planar extension of the spacer element, such that the longitudinal axis of the bracket support shank encloses an angle with the longitudinal extension of the spacer element. The spacer element is typically of a plate-shaped design. Such an element is cuboid or approximately cuboid in shape. When designed as a spacer plate, the longitudinal extension of the spacer element is greater than the width of the support shank. In such a configuration, the support shank is arranged opposite the support plate for installing the spacer, such that its longitudinal extension forms an angle of approx. 90 degrees with the longitudinal extension of the spacer plate. Thus, this spacer plate can be installed without being concerned about the spacer falling over, even on uneven floors or soft surfaces. If the spacer is used for floor installation, the bracket for the spacer plate or the spacer element forms a pedestal. As the gap is formed regularly to a wall, the spacer plate is protected by the wall from tipping over in a direction away from the support shank.

This spacer makes it easy to create a gap between a rigid floor covering and a wall. Once the floor covering has been installed, the spacer plate, depending on the design of the spacer, may be retracted from the bracket support shaft. The bracket, itself, is also retracted from the gap by rotating it, whereby its support shank is retrieved from its position extending under the floor covering. In order to simplify such a pivoting movement of the bracket, one embodiment provides that the support shaft has a rotary drive contour, in particular an external rotary drive contour, on its upper free end section. It may be configured differently depending on the design of the spacer. A first embodiment provides for this rotary drive contour to be designed as an outer polygonal contour, e.g., a hexagonal contour. In many cases, such a contour will suffice for allowing the bracket to rotate about the axis of its support shaft, such that the support shank may pivot freely. A further development of such a spacer provides for a rotary drive contour, which is complementary to the rotary drive contour of the support shaft, to be inserted into a narrow side of the spacer plate or the spacer element. The spacer element previously removed from the support shaft may then be used as a tool for pivoting the bracket.

Another embodiment provides that the hole drilled into the spacer element for receiving the support shaft passes through the spacer plate in its vertical direction, and that the support shaft with its free end section projects from this drill hole, when placing the spacer plate on the support shaft. In order to provide a rotary drive contour, one embodiment provides for this free end section to be angled or for an adjusting handle, which may be strip-shaped in the same way as the support shank, to be molded onto or attached to this free end section. With such a design the spacer plate is typically no longer separable from the bracket. For such a spacer, the adjusting handle is designed such that it projects from the support shaft in the same direction as the support shank. This adjustment handle then also provides an indication of the direction, in which the support shank reaching under the floor covering is currently pointing.

The spacer element itself, which is typically implemented as a spacer plate, may be made in a uniform material thickness, i.e., with two parallel spacer surfaces, one of which contacts the wall and the other contacting the front side of the rigid floor covering. The spacer plate may obviously also be designed with a wedge-shaped thickness or a design, in which the spacer plate has two thicknesses, with a first material thickness in a lower section, and a second material thickness in an upper section. These two different material thicknesses will be provided depending on two preferred gap widths. If providing such a spacer plate, it may be fitted detachably on the bracket support shaft.

Depending on the preferred width of the gap, the spacer plate is attached on the support shaft with one material thickness, or with the other material thickness, as the lower section. Such a spacer-plate design is useful, in that different spacer elements need no longer be used to create gaps of two different widths, instead the gap width is selected according to the orientation in which the spacer plate is attached on the bracket support shaft. Such a design allows for either one to be provided with different colors related to the material thickness and thus the width of the gap to be installed. This allows for mounting of the spacer plates relative to the brackets without problems, such as with an inspection performed after installation of the spacers as to whether all the installed spacers are oriented in the same way with respect to the orientation of their spacer plate.

Given the concept outlined above, such a spacer may also be used for other projects, where a gap at the wall connection is to be kept clear, e.g., stucco work on the ceiling. With such an embodiment, the strip-shaped support shank is meant to engage behind an object held on the ceiling, such that it also forms a suspension hook for the spacer. Using the spacer in this way means that spacer element is connected to the bracket, such that the spacer plate will not slide down the bracket support shaft, when it and its support shank reaches behind a ceiling element, and the support shaft is facing downward. This is achievable by having the support shaft pass through a drill hole extending through the spacer plate and being angled at the end, or carrying an angled adjustment handle, as described above. The spacer plate may also be connected to the support shank by means of a latching connection, e.g., by using a snap ring held in a circumferential groove in the wall of the drill hole, which snap ring engages in a latching groove provided in the bracket support shaft at the corresponding position.

The spacer element of such a spacer may be made of virtually any material, provided it has the requisite spacing properties. Typically, it is manufactured as a plastic part. The bracket may also be a plastic part. In many cases, however, the bracket is preferably designed as a metal part.

BRIEF DESCRIPTION OF THE DRAWINGS

The descriptions below utilize example embodiments with reference to the attached drawings, wherein.

DETAILED DESCRIPTION

Figure 1:
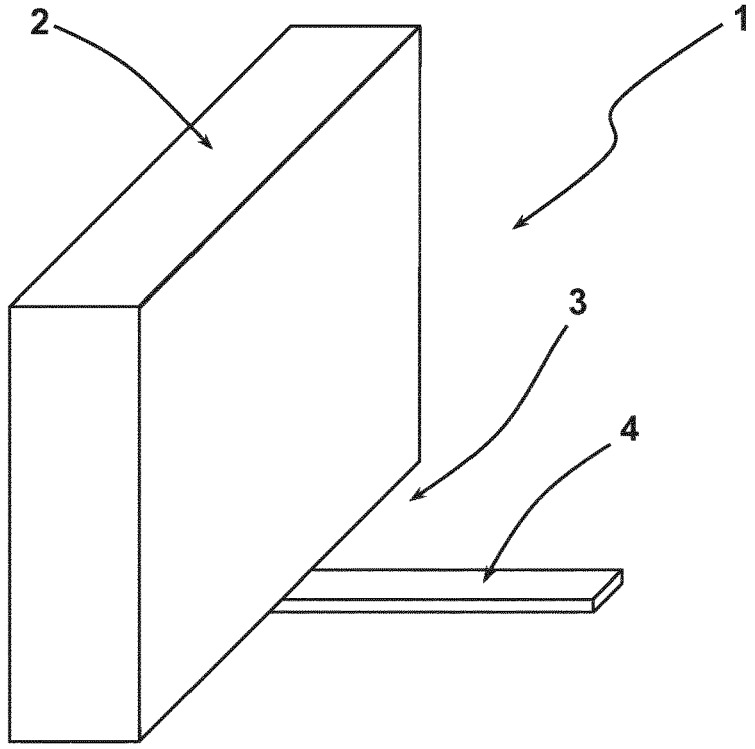
FIG. 1 shows a spacer according to a first embodiment of the present disclosure.
Figure 2:
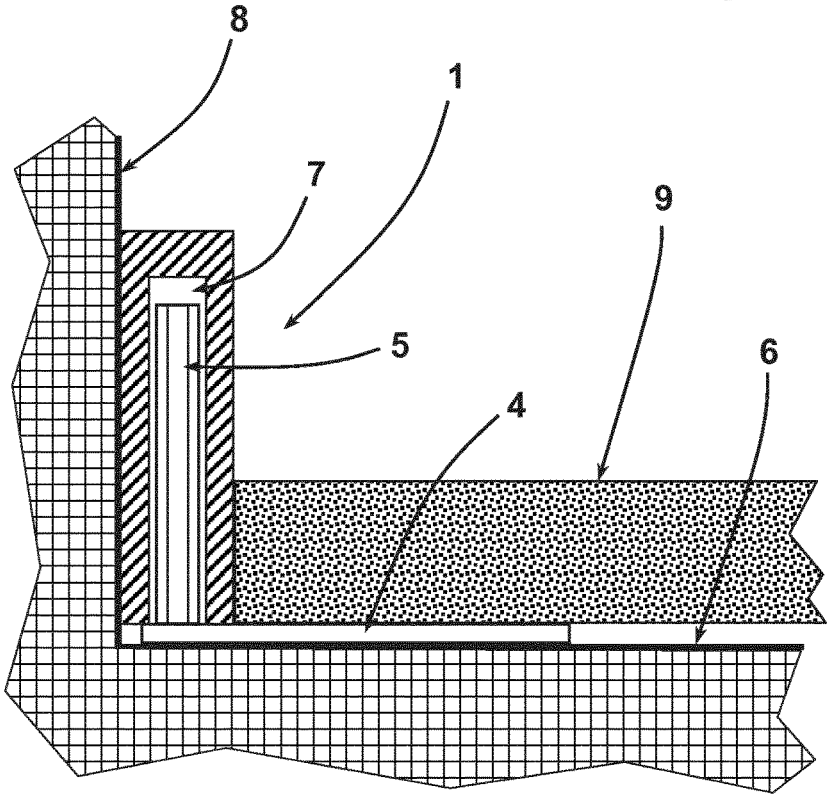
FIG. 2 shows a sectional view of the spacer of FIG. 1, positioned on a floor-side wall connection.

A spacer 1 is used to keep a gap at the wall-connection side clear in connection with the installation of a rigid floor covering. The spacer 1 comprises a cuboid spacer plate 2 as a spacer element, which in the example embodiment shown is a cuboid plastic block. The width of the spacer plate 2 matches the gap width of a rigid floor covering to be kept clear opposite a wall. The width of the spacer plate shown in FIG. 1 is 15 mm. Furthermore, spacer 1 is associated with a bracket 3, whereof only the support shank 4 is visible in the view of FIG. 1. The support shank 4 is strip-shaped and has a thickness of about 2 mm. The support shank is a sheet steel part. Furthermore, the thickness of the support shank may be different, in particular the support shank 4 may also be thinner. When using the spacer 1, while installing a rigid floor covering, such as a laminate, the support shank 4 reaches below the edge laminate panel. A support shaft 5 is molded onto the support shank 4 of the bracket 3, as shown in FIG. 2. In the embodiment shown, the support shaft 5 is designed as a hexagonal shaft.

FIG. 2 shows the spacer 1 in a sectional view, in which it is used to keep a gap clear. The support shank 4 of the bracket 3 rests on the floor 6. The spacer plate 2 has a hole 7 drilled into its lower longitudinal narrow side and is placed together with it on the support shaft 5. The spacer plate 2 is supported on the rear side by a wall 8 adjoining the floor 6, opposite which the gap is to be kept clear. As can be seen from the perspective illustration in FIG. 1, spacer 1 cannot fall over due to the support shank 4 of its bracket 3 projecting from the planar extension of spacer plate 3. Subsequently, a laminated panel 9 is placed on support shank 4, with its front side facing the wall 8 pushed against the corresponding spacer-plate 2 surface. Moreover, during this operation, its safe positioning ensures that there is no risk of the spacer 1 not remaining in place and tipping over.

If the floor covering has been installed and the spacers 1 are to be removed, then the spacer plate 2 is first removed from the support shaft 5 of the respective bracket 3. Using the polygonal contour of the support shaft 5, bracket 3 may then be pivoted around the longitudinal axis of its support shaft 5 in order to rotate the support shank 4 out from its position reaching under the laminate panel 9, until its longitudinal axis is approximately aligned with the longitudinal axis of spacer plate 2 prior to removal. Bracket 3 can then be retracted from the gap. Thus, the width of the support shank 4 is smaller than the gap to be installed.

Figure 3:
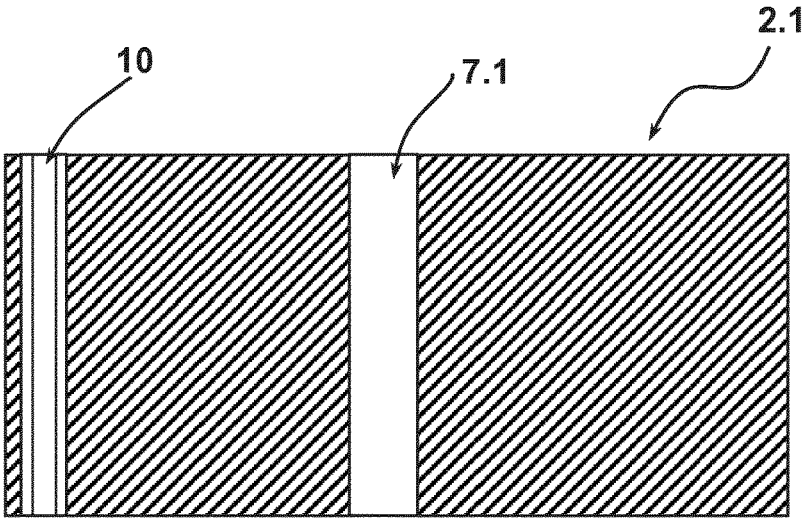
FIG. 3 shows a longitudinal section in the planar extension of a spacer plate of a further spacer.

FIG. 3 shows a further spacer plate in a section within its longitudinal plane 2.1. In principle, it is designed similar to spacer plate 2, but differs in that its drill hole 7.1 extends through the spacer plate 2.1 as a whole. In addition, the spacer plate 2.1 has a contour 10 extending parallel to a narrow-sided termination and passing through the spacer plate 2.1 as a whole, and is designed as an inner polygonal contour complementary to the hexagonal contour of the support shaft 5 of bracket 3. The contour 10 can thus be fitted onto the upper section of the support shaft 5, and the spacer plate 2.1 may be used as a tool for swiveling the support shank 4 out of its position reaching below the laminate panel 9.

Obviously, such a complementary contour, as described for spacer plate 2.1, may also be part of the spacer plate 2 in FIG. 1.

Because of through-hole 7.1, the spacer plate 2.1 may be fitted on the support shaft 5 of bracket 3 with either of its narrow sides facing downward.

The clearance width of drill hole 7 or 7.1 is adjusted to match the outer circumferential surface of support shaft 5, such that a certain amount of play between these two elements remains.

Figure 4:
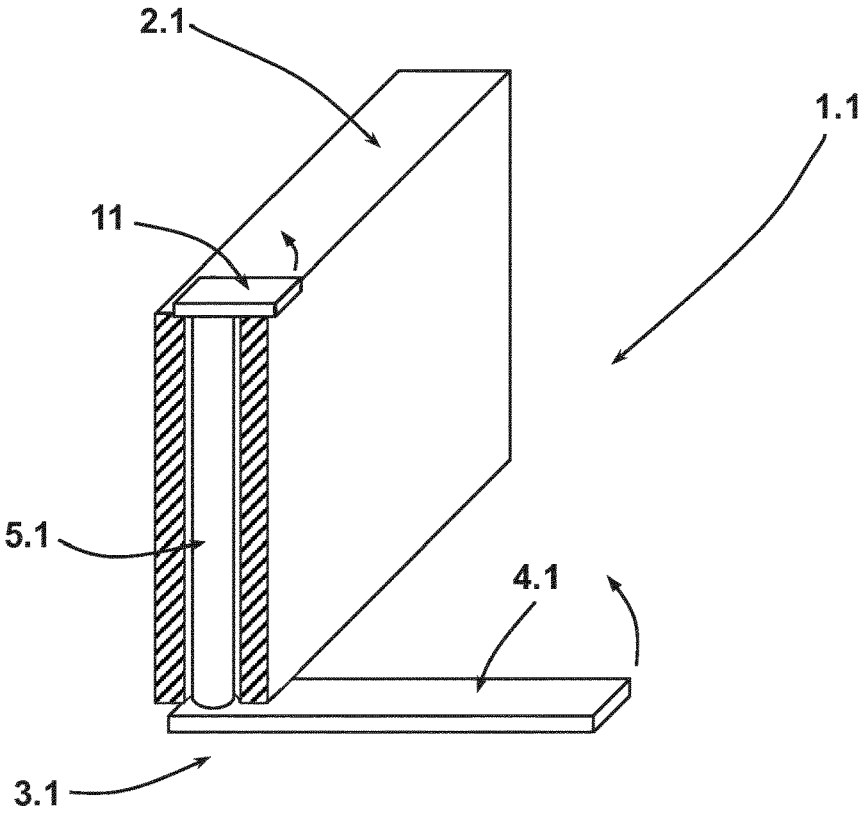
FIG. 4 shows a partially cut perspective view of a further spacer according to the present disclosure.

FIG. 4 shows a further embodiment of a spacer 1.1. Spacer 1.1 has a spacer plate 2.1, as described above for FIG. 3. The bracket 3.1 of spacer 1.1 differs from bracket 3 of the embodiments in FIGS. 1 and 2, in that its support shaft 5.1 passes through the drill hole 7.1 as a whole, and an adjusting handle 11 is attached to the free section projecting from spacer plate 2.1. The adjusting handle 11 projects from support shank 5.1 in the same direction as the support shank 4.1. Thus, the position of the adjusting handle 11 may be used to detect the direction in which the support shank 4.1 reaches under a floor covering resting thereon. By pivoting the adjusting handle 11, as indicated by the arrow in FIG. 4, the support shank 4.1 is similarly pivoted. For this purpose, the adjusting handle 11 and the support shank 4.1 are obviously attached non-rotatably to support shaft 5.1.

The invention is described by means of exemplary embodiments. Without departing from the scope of the claims, numerous other options and possibilities are available to a person skilled in the art for implementing the inventive concept without these needing to be presented in more detail in the context of this disclosure.

REFERENCE NUMERAL LIST

1,1.1 Spacer
2, 2.1 Spacer plate
3, 3.1 Bracket
4, 4.1 Support shank
5, 5.1 Support shaft
6 Floor
7, 7.1 Drill hole
8 Wall
9 Laminated panel
10 Contour
11 Adjusting handle

The invention claimed is:

1. A spacer for keeping clear a gap on a wall-connection side when installing a rigid floor covering, comprising:

a spacer element with a thickness equaling a width of the gap to be kept clear, and a bracket with a strip-shaped support shank for reaching under the installed floor covering, whose width is less than the gap, and with a support shaft connected at one end of the support shank and projecting from the support shank, wherein the spacer element has a drill hole extending in a vertical direction, into which drill hole the support shaft extends, and wherein the spacer element and the bracket are detachable from one another, or an end section of the support shaft opposite the support shank has a rotary drive contour.

2. The spacer of claim 1, wherein the drill hole of the spacer element for receiving the support shaft extends through the spacer element, and a length of the support shaft substantially equals a height of the spacer element.

3. The spacer of claim 1, wherein the drill hole of the spacer element for receiving the support shaft extends through the spacer element, the support shaft of the bracket extends through the drill hole, and the support shaft projects with the end section from the drill hole.

4. The spacer of claim 1, wherein the rotary drive contour is an outer polygonal contour.

5. The spacer of claim 4, wherein another rotary drive contour complementary to the rotary drive contour of the support shaft is arranged in a narrow edge of the spacer element.

6. The spacer of claim 1, wherein the rotary drive contour of the end section of the support shaft is angled relative to another section of the support shaft which extends through the drill hole of the spacer element.

7. The spacer of claim 6, wherein an angled direction of the end section of the support shaft is provided in the same direction in which the support shank projects from the support shaft.

8. The spacer of claim 1, wherein the spacer element is a cuboid body or designed as a spacer plate.

9. The spacer of claim 1, wherein the spacer element has two parallel spacer surfaces.

10. The spacer of claim 1, wherein the spacer element is a plastic part.

11. The spacer of claim 1, wherein the bracket is a metal part.

* * * * *